US006942513B2

(12) United States Patent
Zheng et al.

(10) Patent No.: US 6,942,513 B2
(45) Date of Patent: Sep. 13, 2005

(54) CARD CONNECTOR

(75) Inventors: Qinsheng Zheng, Kunsan (CN); Shaoping Du, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/979,699

(22) Filed: Nov. 1, 2004

(65) Prior Publication Data

US 2005/0095893 A1 May 5, 2005

(30) Foreign Application Priority Data

Nov. 4, 2003 (TW) ..... 92219546 U

(51) Int. Cl.[7] ..... H01R 13/62
(52) U.S. Cl. ..... 439/326; 439/630
(58) Field of Search ..... 439/326, 331, 439/341, 630, 631

(56) References Cited

U.S. PATENT DOCUMENTS 5,603,629 A * 2/1997 DeFrasne et al. ..... 439/331
5,813,878 A * 9/1998 Kuwata et al. ..... 439/326
6,095,868 A * 8/2000 Hyland et al. ..... 439/630
6,174,188 B1 1/2001 Martucci
6,219,036 B1 * 4/2001 Urita ..... 345/161
6,227,893 B1 * 5/2001 Kaneko ..... 439/326
6,234,810 B1 * 5/2001 Schnell et al. ..... 439/76.1
6,319,036 B1 * 11/2001 Zheng et al. ..... 439/326

* cited by examiner

*Primary Examiner*—Thanh-Tam Le
(74) *Attorney, Agent, or Firm*—Wei Te Chung

(57) ABSTRACT

An electrical card connector (100) is provided for interconnecting an electrical card (9) with a printed circuit board and includes a base member (1), a cover (2), a connecting element (4) for pivotally connecting the cover with the base, a first hinge (3) and a second hinge (5). The base member includes an insulative housing (11) and a plurality of conductive terminals mounted in the housing. The cover includes a receptacle (20) for receiving the card. The connecting element includes a body portion (41) and a first mating sleeve (42) and a second mating sleeve (43) respectively at an upper and a lower portion of the body portion for engaging with the first and second hinges, thereby pivotally connecting the cover and the base member.

4 Claims, 4 Drawing Sheets

CARD CONNECTOR

BACKGROUND OF THE INVENTION

1. Field of the Invention

This invention generally relates to an electrical connector and more particularly, to an electrical card connector for connecting an electrical card with a printed circuit board of an electrical device.

2. Description of the Prior Art

IC cards have been developed, a type of IC card, called a subscriber identification module card (SIM card) is used in cellular phones as an identification and storage unit for subscriber related data. SIM cards normally include a terminal array for connection through a card connector to the external equipment. The connector usually includes a card socket for receiving the IC card and a plurality of resilient contacts for engaging the terminal array of the card when the card is inserted into the socket.

With the ever-increasing miniaturization of IC cards and their respective connectors, various problems continue to arise. For instance, the very handling of the miniature IC cards is difficult. U.S. Pat. No. 6,174,188 B1 discloses a card connector. The conventional electrical connector includes a base member mounted on an electronic device and a cover pivotally connected to the base member through a hinge. In the conventional connector, the cover pivots toward and away from the base member around the single hinge. In the current trend of compact, there must be a lot of electronic elements located around the base member of the connector. When the cover pivots away from the base member, a lower end of the cover tends to strike some of the electronic elements and damages the electronic elements. At the same time, the cover may be damaged by counterforce of these electronic elements.

BRIEF SUMMARY OF THE INVENTION

It is an object of the present invention to provide a card connector which has a good pivotal structure and a relatively long life span.

In order to attain the object above, an electrical card connector is provided for interconnecting an electrical card with a printed circuit board and comprises a base member, a cover, a connecting element for pivotally connecting the cover with the base, a first hinge and a second hinge. The base member includes an insulative housing and a plurality of conductive terminals mounted in the housing. The cover includes a receptacle for receiving the card. The connecting element includes a body portion and a first mating sleeve and a second mating sleeve respectively positioning an upper and a lower portion of the body portion for engaging with the first and second hinges, thereby pivotally connecting the cover and base member.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
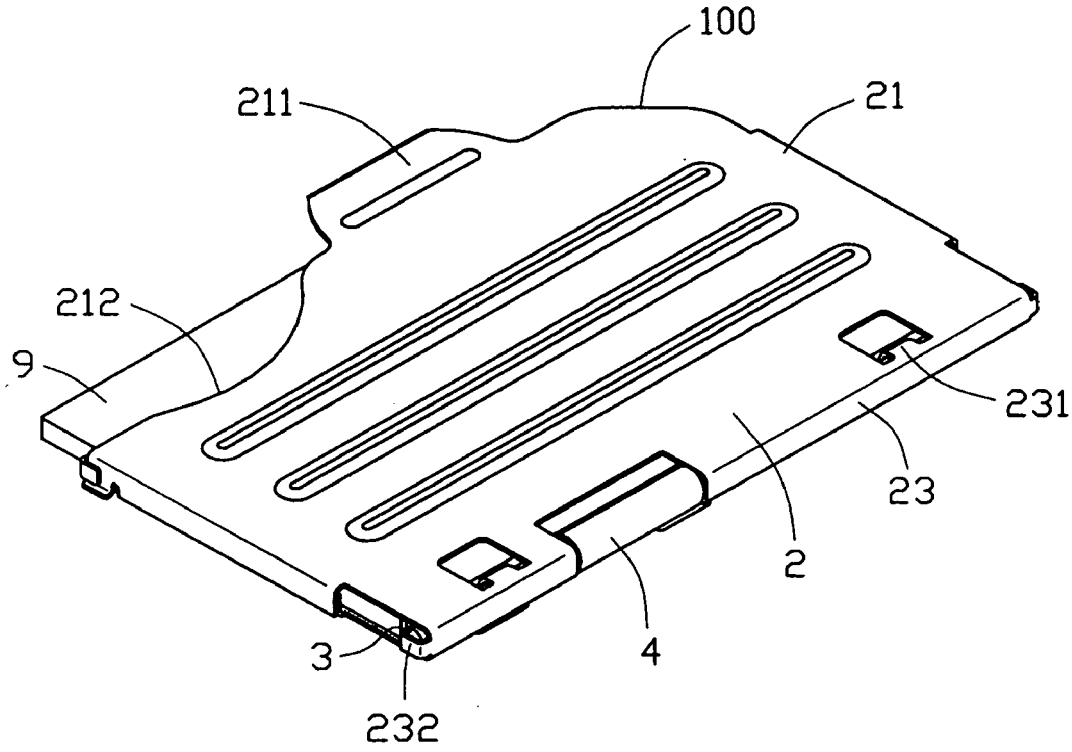
FIG. 1 is a perspective view of a card connector according to the present invention.
Figure 2:
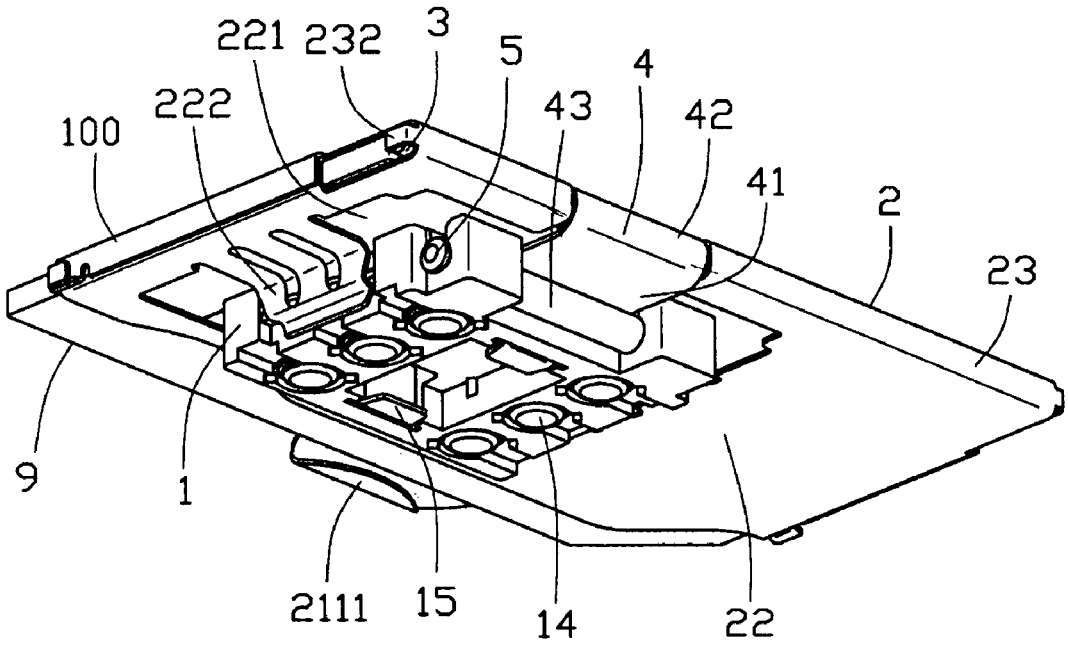
FIG. 2 is another perspective view of the card connector from another perspective.
Figure 3:
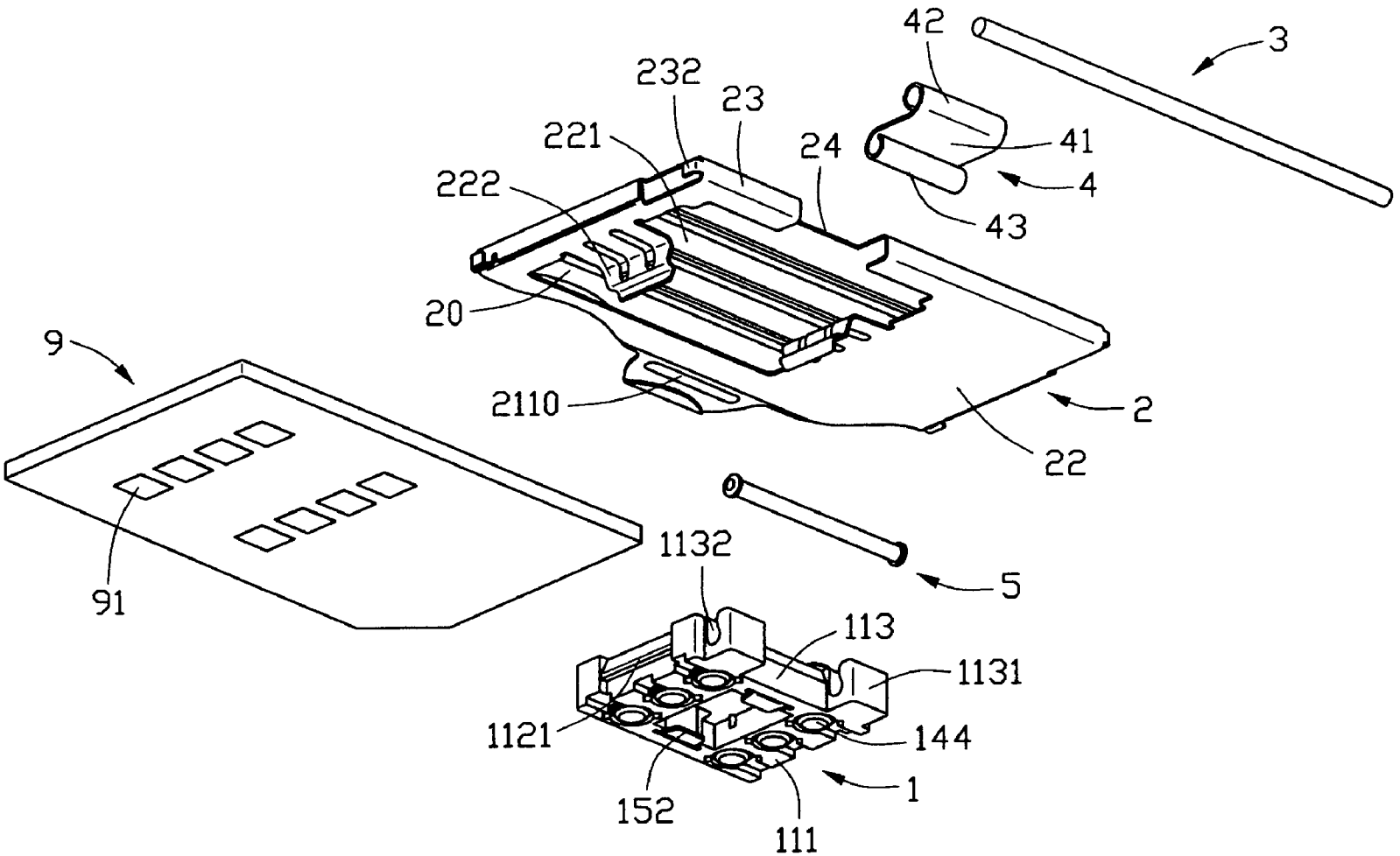
FIG. 3 is an exploded view of the card connector.

Referring to FIGS. 1–3, an electrical card connector 100 according to the present invention for connecting an electrical card 9 with a printed circuit board (PCB, not shown) includes a base member 1, a cover 2 for accommodating the card 9, a connecting element 4 and a first and second hinges 3, 5 for interconnecting the cover 2 with the base member 1.

Figure 4:
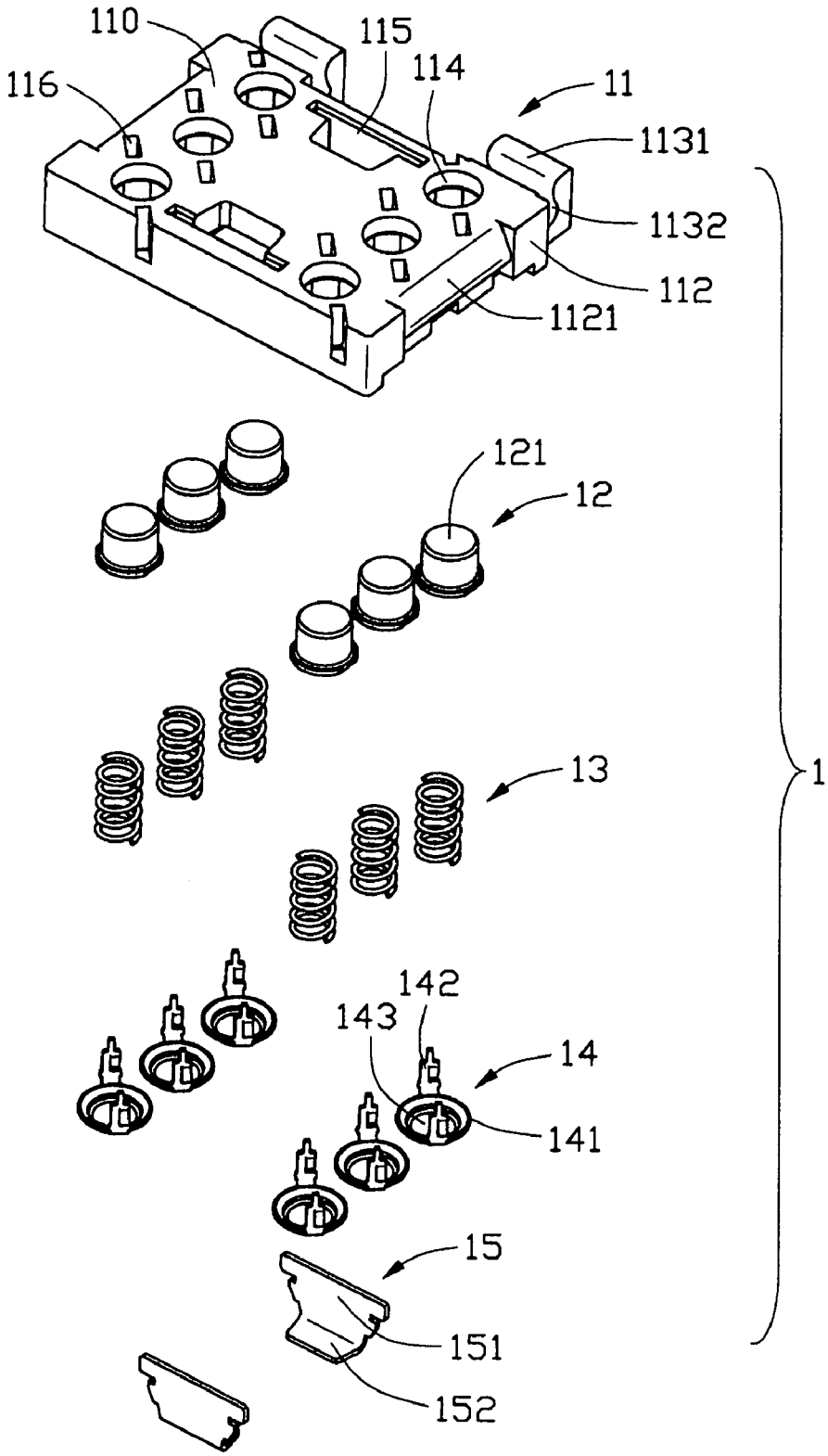
FIG. 4 is a partially exploded view of the card connector.

Referring to FIGS. 3–4, the base member 1 includes a substantially rectangular insulative housing 11, a plurality of conductive contacts held in the housing 11 and a pair of latching tabs 15. The insulative housing 11 comprises an upper wall 110, a lower wall 111, a pair of side walls 112 and a rear wall 113. The housing 11 defines two rows of through sleeves 114 through the upper and lower walls 110, 111 adjacent to corresponding side walls 112. A pair of latching recesses 115 are positioned in a generally middle portion of the housing 11. Each side wall 112 defines a concaved resistant cavity 1121 adjacent to a middle portion thereof. A pair of pivotal portions 1131 extend rearward from opposite side portions of the rear wall 113. An upwardly exposed engaging groove 1132 downwardly depresses from an upper surface (not labeled) of each pivotal portion 1131 and is parallel to the rear wall 113. The housing 11 has a plurality of pairs of parallel fixing slots 116 through the upper and lower surfaces 110, 111 and each pair of fixing slots 116 are position at opposite sides of each through sleeve 114.

Each conductive contacts received in the housing 11 comprises a contact terminal 12, a coiled spring 13 and a retaining terminal 14. Each contact terminal 12 received in the through sleeve 114 includes a body portion 121 and a receiving cavity (not shown) formed in an inner portion of the body portion 121.

Each retaining terminal 14 includes a base portion 141 and a pair of symmetrical fixing beams 142 extending upwardly from the base portion 141. The base portion 141 has a substantially cap-shaped configuration and (not labeled) defines an upwardly exposed hollow space 143 for abutting against a lower end of the coiled spring 13. The base portion 141 has a soldering nod 144 at opposite surface relative to the hollow space 143 for soldering to the PCB.

The coiled spring 13 is received in the through sleeve 114 of the housing 11. The lower end of the spring 13 abuts against the hollow space 143 of the retaining terminal 14 and the upper end of the coiled spring 13 extends into the body portion 121 abutting against the inner surface of the receiving cavity.

Each latching tab 15 includes a hook portion 151 latching in the latching recess 115 of the housing 11 and a soldering portion 152 perpendicularly extending from a lower end of the hook portion 151 for soldering to the PCB.

Referring to FIGS. 1–3, the cover 2 includes a top plate 21, a bottom plate 22 and a connecting wall 23 for connecting the top plate 21 and the bottom plate 22, thereby forming a receptacle 20 for receiving the card 9. A front nose portion 211 extends forwardly from a front edge of the top cover 21 and an elongate rib 2110 is downwardly formed on the front nose portion 221. The bottom plate 22 has an opening 221 and a pair of engaging sleeves 222 extending downwardly to each other from opposite edges of the gap 221. The top cover 21 is stamped out a pair of fingers 231 (shown in FIG. 1) in a rear portion thereof. Each finger has a front free end (not shown) downwardly and inwardly bending and extending to the connecting wall 23. The connecting wall 23 includes a pair of resistant pieces 232 forwardly bending and extending from two sides thereof. An elongated channel (not labeled) is defined by the top plate 21, the bottom plate 22, the connecting wall 23, the fingers 231 and the resistant pieces 232 of the connecting wall 23 for receiving the first hinge 3. In addition, a cutout 24 for engaging with the connecting element 4 is defined in a substantially middle portion of the top plate 21, the bottom plate 22 and the connecting wall 23 and is positioned between the fingers 231.

Referring to FIG. 3, the connecting element 4 is formed of metal sheet and includes a substantially rectangular body portion 41. The body portion 41 comprises an end rolled upwardly to define a first mating sleeve 42 and an opposite end rolled downwardly to define a second mating sleeve 43. The first mating sleeve 42 is provided for receiving the first hinge 3. The second mating sleeve 43 is provided for receiving the second hinge 5. In this embodiment, the first and second mating sleeves 42, 43 are rolled toward different directions and are located on opposite sides of the body portion 41. It is to be understood, the two mating sleeves 42, 43 may be rolled toward the same direction and are located in the same side of the body portion 41.

Referring to FIGS. 1–4, in assembly, firstly, the contact terminals 12, the coiled springs 13 and the retaining terminals 14 are installed into the through holes 114 of the housing 11 from the lower surface 111 of the housing 11 in turn. The coiled springs 13 are received in the through hole 114 of the housing 11 and the upper end of each coiled spring 13 extends into the receiving cavity of the contact terminal 12. The fixing beams 142 of the retaining terminals 14 are inserted into the fixing slots 116 of the housing 11 for fixing the retaining terminals 14 to the housing 11. The soldering nod 144 of the retaining terminal 14 projects beyond the lower surface 111 of the insulative housing 11, thereby facilitating to solder the base member 1 to the printed circuit board. The hook portion 151 of the latching tab 15 is inserted into in the latching recess 115, the soldering portion 152 projects beyond the lower surface 111 of the insulative housing 11 for facilitating soldering to the PCB. Secondly, the first hinge 3 is assembled in the channel of the cover 2, with a middle portion thereof being assembled into the first mating sleeve 42 of the connecting element 4 and opposite ends thereof engaging with the resistant pieces 232 of the connecting wall 23. The second hinge 5 engages with the second sleeve 43 of the connecting element 4 and comprises opposite ends received in the engaging groove 1132 of the pivotal portion 1131 of the base member 1. Therefore, the cover 2 is mounted on the base member 1. At the same time, the cover 2 can rotate toward and away from the base member 1 around the first and second hinges 3, 5. Finally, the electrical card connector 100 is mounted on the PCB.

Referring to FIGS. 1–2, in using, firstly, the card 9 is inserted into the receptacle 20 of the cover 2 and retained by the rib 2110 of the top cover 21 and cannot move in front-to-rear directions. Secondly, the cover 2 pivots to the base member 1 and is positioned in a closed position. In addition, the engaging sleeves 222 of the bottom plate 22 engage with the resistant slots 1121, thereby securely mounting the cover 2 on the base member 1. The card 9 exerts a downwardly depressing force on the contact terminals 12 and the coiled springs, at the same time, the card 9 gets an upwardly counterforce from them, thereby forming an electrical connecting between the conductive terminals and the card 9. When the card 9 is extracted from the receptacle 20 of the cover 2, firstly, the engaging sleeves 25 free from the resistant slots 1121 and the cover 2 moves away from the base 1 around the first and second hinges 3, 5. The electrical connector 100 includes the connecting element 4 between the cover 2 and the base member 1, therefore, the cover 2 can rotate the base member 1 around the first and second hinges 3, 5. As a result, the cover 2 is provided with greater free region and can be handled more flexibly. Furthermore, the electrical connector 100 may be assembled the PCB with a lot of electrical elements closely around the electrical connector 100, thereby making the PCB compact and saving more room.

In addition, the connecting element 4 may not connect with the cover 2 and the base member 1 through the first and second hinges 3, 5. The connecting element 4 may also interconnect the cover 2 with the base member 1 adopting prior arts, for example, the connecting element 4 adopts a fixing nod, the base member 1 and the cover 2 adopt a receiving recess for receiving the fixing nod.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for connecting an electrical card with a printed circuit board, comprising:

a base member including an insulative housing and a plurality of conductive contacts mounted in the housing;

a cover for accommodating the electrical card and moving toward and away from the base member;

a first and a second hinges; and a connecting element for interconnecting the cover with the base member, the connecting member including a body portion, one end of the body portion pivotally connecting with the base member, another end pivotally connecting with the cover;

wherein the connecting element including a first mating sleeve and a second mating sleeve respectively at the ends of the body portion;

wherein the first and second hinges respectively engaging with the first and second mating sleeves;

wherein the cover including an upper plate, a bottom plate and a connecting wall;

wherein the upper plate including fingers positioned adjacent to the connecting wall and inwardly and downwardly bending and extending to the connecting wall for retaining the first hinge; and wherein the base member including an engaging groove thereof for engaging with the second hinge.

2. The card connector according to claim 1, wherein the upper plate, the bottom plate and the connecting wall together define a cutout.

3. The card connector according to claim 1, wherein the connecting wall includes a pair of resistant pieces forwardly bending and extending from two sides thereof.

4. The card connector according to claim 3, wherein the top plate, the bottom plate, the connecting wall, the fingers and the resistant pieces together define a receiving channel for receiving the first hinge.

* * * * *